US010278460B2

(12) United States Patent
Catanese

(10) Patent No.: US 10,278,460 B2
(45) Date of Patent: May 7, 2019

(54) BRACELET CLASP

(71) Applicant: Omega SA, Biel/Bienne (CH)

(72) Inventor: Rocco Catanese, Bienne (CH)

(73) Assignee: Omega SA, Biel/Bienne (CH)

( * ) Notice: Subject to any disclaimer, the term of this patent is extended or adjusted under 35 U.S.C. 154(b) by 251 days.

(21) Appl. No.: 15/085,310

(22) Filed: Mar. 30, 2016

(65) Prior Publication Data

US 2016/0309859 A1 Oct. 27, 2016

(30) Foreign Application Priority Data

Apr. 23, 2015 (EP) ..... 15164867

(51) Int. Cl.
*A44C 5/24* (2006.01)
*A44B 11/22* (2006.01)

(52) U.S. Cl.
CPC ..... *A44C 5/24* (2013.01); *A44C 5/246* (2013.01); *A44B 11/226* (2013.01)

(58) Field of Classification Search
CPC ..... A44B 11/06; A44B 11/00; A44C 5/24; A44C 5/246
See application file for complete search history.

(56) References Cited

U.S. PATENT DOCUMENTS 1,741,421 A * 12/1929 Kraemer ..... A44C 5/24 24/71 J
3,665,564 A * 5/1972 Oka ..... A44C 5/24 24/265 WS
3,797,716 A * 3/1974 Mochizuki ..... A44C 5/24 224/176
4,545,095 A * 10/1985 Fontana ..... A44C 5/24 24/265 WS
5,485,659 A * 1/1996 Kashikie ..... A44C 5/2052 24/265 WS (Continued)

FOREIGN PATENT DOCUMENTS

CH 702 523 A2 7/2011
DE 61468 3/1892

(Continued)

OTHER PUBLICATIONS

European Search Report dated Oct. 22, 2015 in European application 15164867.2, filed on Apr. 23, 2015 (with English Translation).

*Primary Examiner* — Jason W San
(74) *Attorney, Agent, or Firm* — Oblon, McClelland, Maier & Neustadt, L.L.P.

(57) ABSTRACT

The invention relates to a bracelet clasp including a securing member provided with means for adjusting the useful length of the bracelet, these adjustment means including:

a base plate secured and pivotally hinged to the second end of the second strip, the first strand passing between the base plate and the second strip and being held by holding means, second means for locking the base plate in a closed position on the second strip.

According to the invention, the second locking means include a push-piece arranged to be moved between a first rest position wherein the base plate is locked in a closed position on the second strip, and a second pushed-in position in which the base plate is released from the second strip.

9 Claims, 4 Drawing Sheets

(56) References Cited

U.S. PATENT DOCUMENTS

| | | | | |
|---|---|---|---|---|
| 5,787,554 | A * | 8/1998 | Hashimoto | A44C 5/185 24/265 WS |
| 5,829,104 | A * | 11/1998 | Gay | A44C 5/24 24/71 J |
| 6,434,798 | B1 * | 8/2002 | Yamakawa | A44C 5/24 24/265 WS |
| 6,792,652 | B2 * | 9/2004 | Ferrario | A44C 5/24 24/265 WS |
| 8,739,369 | B2 * | 6/2014 | Kaltenrieder | A44C 5/24 24/265 WS |
| 8,935,834 | B2 * | 1/2015 | Mouche | A44C 5/24 224/164 |
| 9,003,611 | B2 * | 4/2015 | Catanese | A44C 5/24 24/71 J |
| 9,173,460 | B2 * | 11/2015 | Kaltenrieder | A44C 5/24 |
| 9,591,899 | B2 * | 3/2017 | Catanese | A44B 11/226 |
| 9,615,634 | B2 * | 4/2017 | Kaltenrieder | A44C 5/246 |
| 9,681,711 | B2 * | 6/2017 | Monard | A44C 5/04 |
| 2013/0160255 | A1 * | 6/2013 | Schmidt | A44C 5/14 24/71 J |
| 2014/0059818 | A1 * | 3/2014 | Catanese | A44C 5/24 24/71 J |
| 2016/0081440 | A1 * | 3/2016 | Baek | A44C 5/246 24/71 J |
| 2016/0113361 | A1 * | 4/2016 | Kaltenrieder | A44C 5/24 63/3.1 |
| 2017/0215531 | A1 * | 8/2017 | Wong | A44C 5/027 |

FOREIGN PATENT DOCUMENTS

| | | | |
|---|---|---|---|
| EP | 0 344 620 | A1 | 12/1989 |
| EP | 0 607 726 | A1 | 7/1994 |
| EP | 1 943 917 | A2 | 7/2008 |

* cited by examiner

Fig. 3B
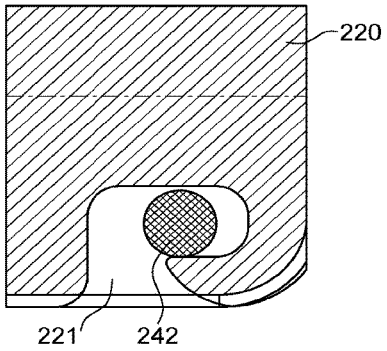
Fig. 3A
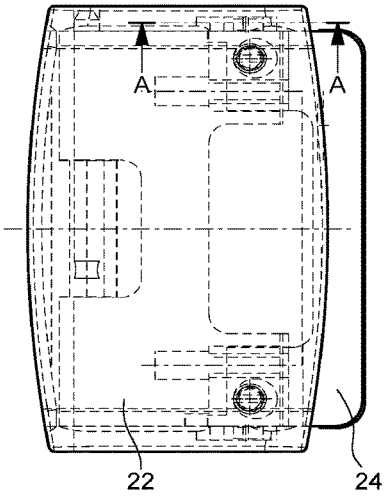
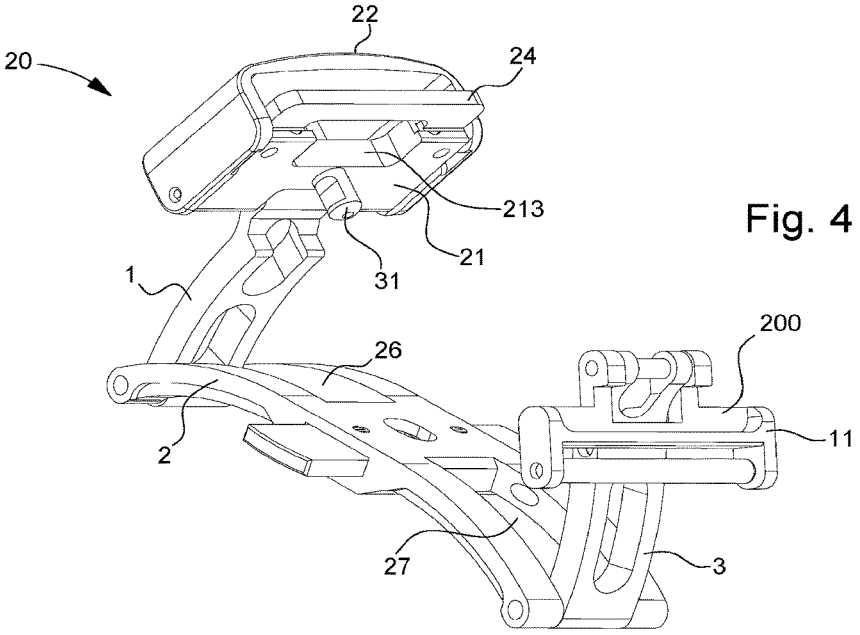
Fig. 4

BRACELET CLASP

This application claims priority from European Patent Application No. 15164867.2 filed on Apr. 23, 2015, the entire disclosure of which is hereby incorporated herein by reference.

FIELD OF THE INVENTION

The invention relates to a clasp for a bracelet or wristlet with an adjustable strand, and in particular for watch bracelets or straps.

BACKGROUND OF THE INVENTION

There is known from EP Patent No 0607726 a bracelet clasp having a mechanism including a base plate hinged to the end of a strip, and an inverted U-shaped cover projecting over the base plate and whose two free edges are respectively extended on the same side by a lateral arm, the end of which is rotatably mounted on the corresponding lateral face of the base plate. The free edges of the cover can be locked by lateral locking means, the adjustable strand passes between the base plate and the cover, and is retained by a stud protruding from the inner face of the base plate or of the cover.

It is not easy for a user to operate such a mechanism since it is necessary to unlock the mechanism using a nail in order to adjust the length of the strand, and to hold the base plate when it is desired to change the length of the bracelet strand. Furthermore, the locking of the mechanism is not entirely secure, since the cover may be unlocked if it becomes caught or if there is a shock when the bracelet is worn.

SUMMARY OF THE INVENTION

It is an object of the invention to overcome the various drawbacks of these known techniques.

More specifically, it is an object of the invention to provide a clasp permitting the length of a bracelet strand to be adjusted simply and quickly.

It is also an object of the invention, at least in a particular embodiment, to provide a clasp that is simple to implement and inexpensive.

These objects, in addition to others that will appear more clearly below, are achieved by the invention with the aid of a bracelet clasp of the type with a deployment buckle, including at least first and second strips, the first strip being hinged to the second strip by a first end, between a closed position, called the wearing position, in which the first strip is folded onto the second strip, and an open position in which the first strip is released from the second strip, the second strip carrying, at a second end, a member for securing a first bracelet strand, a second bracelet strand being connected at least indirectly to the second strip, the first strip including first locking means able to hold the first strip in the closed position, the securing member including means for adjusting the useful length of the bracelet, these adjustment means including:

a base plate secured and pivotally hinged to the second end of the second strip, the first strand passing between the base plate and the second strip and being held by holding means, second means for locking the base plate in a closed position on the second strip.

According to the invention, the second locking means include a push-piece arranged to be moved in a longitudinal direction of the bracelet, in response to an action of the user, between a first rest position in which the base plate is locked in a closed position on the second strip, and a second pushed-in position in which the base plate is released from the second strip.

The invention also concerns a bracelet clasp, of the type with a deployment buckle, including at least first and second strips, the first strip being hinged to the second strip by a first end, between a closed position, called the wearing position, in which the first strip is folded onto the second strip, and an open position, in which the first strip is released from the second strip, the first strip carrying, at a second end, a member for securing a first bracelet strand, a second bracelet strand being at least indirectly connected to the second strip, the first strip including first locking means capable of holding the first strip in its closed position.

The securing member includes means for adjusting the useful length of the bracelet, these adjustment means including:

a base plate secured to the second end of the first strip, a cover pivotally hinged to the base plate, the first strand passing between the base plate and the cover and being held by holding means, second means for locking the cover in the closed position on the base plate.

According to the invention, the second locking means include a push-piece arranged to be moved in a longitudinal direction of the bracelet, in response to an action of the user, between a first rest position in which the cover is locked in a closed position on the base plate, and a second pushed-in position in which the cover is released from the base plate.

In accordance with other advantageous variants of the invention:

the cover has an L-shaped groove on the inner face of each of its lateral walls, in proximity to one of its ends;

the base plate has an L-shaped groove on each of its lateral edges;

the push-piece includes a pin on each of its edges, each pin being configured to cooperate with the corresponding L-shaped groove;

the second strip includes a bridge at the end receiving the base plate, the bridge including a pin on each of its edges, each pin being configured to cooperate with the corresponding L-shaped groove;

the second locking means include return means configured to cooperate with the push-piece to hold the push-piece in a closed position;

the return means include at least one spring;

the base plate includes means for guiding the push-piece;

the return means rest in said push-piece guide means;

the base plate has a stud on its upper face, called the upper stud, intended to be inserted in a suitable hole of the bracelet strand to define an anchoring point;

the first strand is inserted through the adjustment means, where the cover is hinged on the base plate;

The first strand is inserted through the adjustment means, where the base plate is hinged on the second strip.

The invention also concerns a wristwatch including a bracelet provided with a clasp according to the invention.

The invention also concerns a module for securing a strand to a fastener including a securing member provided with means for adjusting the useful length of the strand, these adjustment means including:

a base plate, a cover pivotally hinged to the base plate, the strand passes between the base plate and the cover and is held by holding means, second means for locking the cover on the base plate in the closed position, provided in said base plate, the second locking means include a push-piece arranged to be moved in a longitudinal direction of the bracelet, in response to an action of the user, between a first rest position in which the cover is locked in the closed position on the base plate, and a second pushed-in position in which the cover is released from the base plate.

Thus, by means of the various functional and structural aspects described above, the present invention makes it possible to obtain a clasp wherein the useful length of a strand can be adjusted in a particularly easy and rapid manner.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which:

FIG. 3*a* is a top view of the second clasp locking means according to the invention.

FIG. 3*b* is a cross-sectional view along the line AA of FIG. 3*a* of the second clasp locking means according to the invention.

FIG. 4 is a perspective view of a clasp according to a second embodiment of the invention.

DETAILED DESCRIPTION OF PREFERRED EMBODIMENTS

Figure 1:
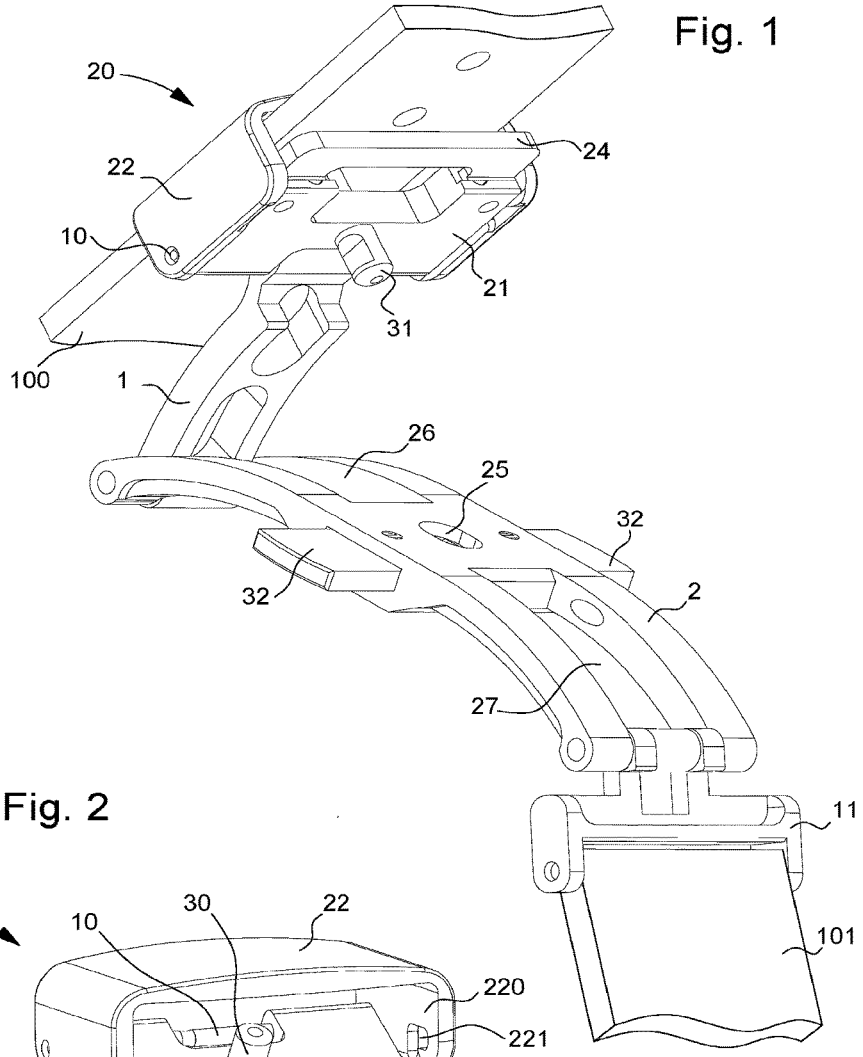
FIG. 1 is a perspective view of a clasp according to the invention.

A bracelet clasp with an adjustable strand according to a first example embodiment will now be described below with reference jointly to FIGS. 1, 2, 3*a* and 3*b*.

According to a first embodiment, the invention concerns a bracelet clasp, of the type with a deployment buckle, including at least first and second strips, the first strip 1 being hinged to the second strip 2 by a first end, between a closed position, called the wearing position, in which the first strip 1 is folded onto the second strip 2, and an open position, in which the first strip 1 is released from the second strip 2.

First strip 1 carries, at a second end, a member 20 for securing a first bracelet strand 100, a second bracelet strand 101 being at least indirectly connected to second strip 2 by means of an attachment link 11 for example, first strip 1 including first locking means capable of holding first strip 1 in its closed position.

Strands 100, 101 may be manufactured in materials such as leather, fabric, canvas, or any other material known to those skilled in the art for producing bracelets or belts.

The first locking means may be formed, for example, by at least one spring catch 32 configured to hold and/or release a stud, called the lower stud 31, so as to hold first strip 1 in its closed position against second strip 2 or to release first strip 1 into its released position.

Second strip 2 may, for example, have a through orifice at the centre thereof, called the central orifice 25, the central orifice being configured to receive lower stud 31 so that lower stud 31 cooperates with the spring catch. Of course, other locking means could have been envisaged by those skilled in the art within the scope of the present invention.

Figure 2:
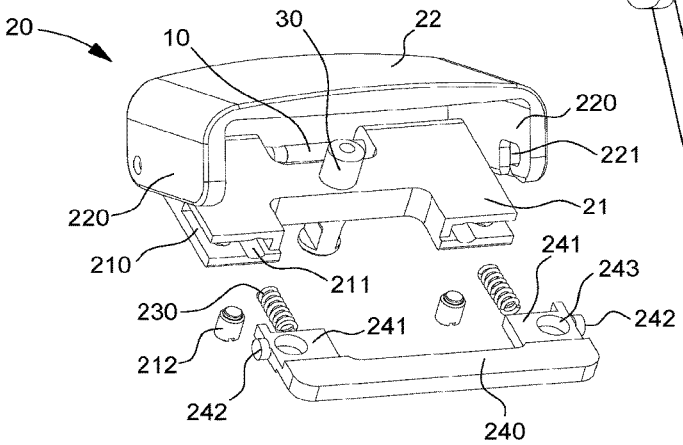
FIG. 2 is an exploded view of second means for locking a clasp according to the invention.

As can be observed in FIGS. 1 and 2, securing member 20 includes means for adjusting the useful length of the bracelet, these adjustment means include:

a base plate 21 pivotally hinged to the second end of first strip 1, the base plate being held by a bar 10, and an inverted U-shaped cover 22, pivotally hinged to base plate 21, cover 22 being held to base plate 21 via its lateral edges by means of bar 10.

This arrangement of base plate 21 and cover 22 makes it possible for first strand 100 to pass between base plate 11 and cover 22. Advantageously, the first strand 100 passes through the adjustment means, where the cover is hinged on the base plate. As can be observed in the Figures, first strand 100 is held in its position via holding means such as a stud, called upper stud 30, intended to be inserted into a suitable hole of first strand 100 to define an anchoring point of the latter to the clasp. Of course, other holding means could have been envisaged by those skilled in the art within the scope of the present invention.

The adjustment means also include second locking means for holding cover 22 in the closed position on base plate 21.

Advantageously, the second locking means are formed by a push-piece 24 arranged to be moved in a longitudinal direction of first strand 100, in response to an action of the user, between a first rest position in which cover 22 is locked in the closed position on base plate 21, and a second pushed-in position in which cover 22 is released from base plate 21.

As shown in FIG. 2, the second locking means include return means, such as springs 230, configured to exert a force on push-piece 24 so as to hold push-piece 24 in the closed position.

Base plate 21 includes guide means for push-piece 24 and springs 230, the guide means respectively taking the form of a guide slot 210 on either side of base plate 21 for push-piece 24 and of a guide cylinder 211 for each spring 230, springs 230 thus being laterally held in guide cylinders 211.

Advantageously, guide slots 210 are arranged to be open through, so that push-piece 24 can cooperate with the lateral walls of cover 21.

Push-piece 24 is formed by a body, 240, of equivalent width to the width of base plate 21, and has an arm 241 arranged at each of end thereof, arms 241 being configured to slide inside guide slots 210 and to cooperate in abutment with springs 230. As can be observed in the Figures, each arm 241 of push-piece 24 includes a pin 242 oriented towards the exterior of guide slot 210 to cooperate with one of lateral walls 220 of cover 22.

The push-piece also has a through hole 243 in each arm 241, each of through holes 243 being configured to allow a screw 212, fixed to base plate 21, to pass through and thus to hold push-piece 24 in place when it is stressed by springs 230. Through holes 243 have a large diameter than those of screws 212, the difference between the diameters of hole 243 and of screw 212 defining the length of travel of push-piece 24.

According to the invention, cover 22 has an L-shaped groove 221 on the inner face of each of its lateral walls 220, preferably disposed in proximity to one of its ends, each L-shaped groove 221 being configured to cooperate with a respective pin 241 of push-piece 24.

According to a variant embodiment that is not shown in the Figures, cover 22 includes a pin on the inner face of each of its lateral walls 220, and each arm 241 of push-piece 24 includes a groove configured to cooperate with a respective pin of cover 22. Thus, when a user presses push-piece 24, the grooves move and release the pins present on lateral walls 220 of cover 22.

As can be observed in FIG. 3*a*, when cover 22 is in a closed position, springs 230 act upon push-piece 24 so that body 240 of push-piece 24 projects slightly from cover 22 and pins 241 remain in place at the bottom of L-shaped grooves 221. To release cover 22, the user presses push-piece 24 so that pins 241 are stopped in the "foot" of the L of each L-shaped groove 221. The user can then lift cover 22 and release first strand 100 by lifting the latter so as to extract the upper stud from first strand 100.

According to a particularly advantageous aspect of the invention, the user can use the same finger to press push-piece 24 and lift cover 22; the finger is in immediate proximity to cover 22 once the push-piece is in the pushed-in position.

According to a second embodiment of the invention, the bracelet clasp, of the deployment buckle type, includes first, second and third strips, the first strip 1 being hinged to the second strip 2 by a first end, and the third strip 3 being hinged to second strip 2 by the second end, opposite the first end.

First strip 1 and third strip 3 can change from a closed position, called the wearing position, in which first strip 1 and third strip 3 are folded onto second strip 2, to an open position in which first strip 1 and third strip 3 are released from second strip 2.

First strip 1 carries, at a second end, a member 20 for securing a first bracelet strand 100, a second bracelet strand 101 being at least indirectly connected to second strip 2, first strip 1 including first locking means 10 capable of holding first strip 1 in its closed position.

As can be observed in FIG. 4, securing member 20 includes identical means of adjusting the length of first strand 100 to those present in the first embodiment, and consequently these adjustment means will not be described again.

As can be observed in FIG. 4, second strip 2 includes two longitudinal recesses 26 and 27 disposed symmetrically on either side of central orifice 25. Advantageously, longitudinal recesses 26 and 27 are respectively of complementary shape to first strip 1 and third strip 3.

Thus, first strip 1 and third strip 3 rest at least partially in longitudinal housings 26 and 27, so that the second end of first strip 1 and of third strip 3 rests on second strip 2 in immediate proximity to central orifice 25.

As illustrated in FIG. 4, base plate 21 has a hollow 213 in the end receiving push-piece 24 so as to form a housing, between base plate 21 and push-piece 24, which is configured to receive the second end of third strip 3 when first strip 1 and third strip 3 are in a closed position.

According to this particular embodiment of the invention, securing member 20 has a receptacle 200 in which body 240 of push-piece 24 is housed when first strip 1 and third strip 3 are folded onto second strip 2 in the closed position.

To close the clasp, the user first folds third strip 3 onto second strip 2 in the corresponding longitudinal recess 27, so that the second end of third strip 3 is positioned above central orifice 25. Next, the user folds first strip 1 onto second strip 2 in the corresponding longitudinal recess 26, so that the second end of first strip 1 is positioned above central orifice 25, and so that the second end of third strip 3 rests in hollow 213. Finally, strips 1 and 3, are locked once the user positions lower stud 31 in central orifice 25 and locks the stud by means of the first locking means.

A bracelet clasp with an adjustable strand according to a third example embodiment will now be described below with reference jointly to FIGS. 5, 6*a* and 6*b*.

According to this third embodiment, the clasp includes a first strip 1 hinged to a second strip 2 by a first end, between a closed position, called the wearing position, in which first strip 1 is folded onto second strip 2, and an open position, in which first strip 1 is released from second strip 2.

Second strip 2 carries, at a second end, a member 20 for securing a first bracelet strand 100, a second bracelet strand may be at least indirectly connected to first strip 1 by means of an arbor 13 for example, first strip 1 including first locking means capable of holding first strip 1 in its closed position.

Figure 5:
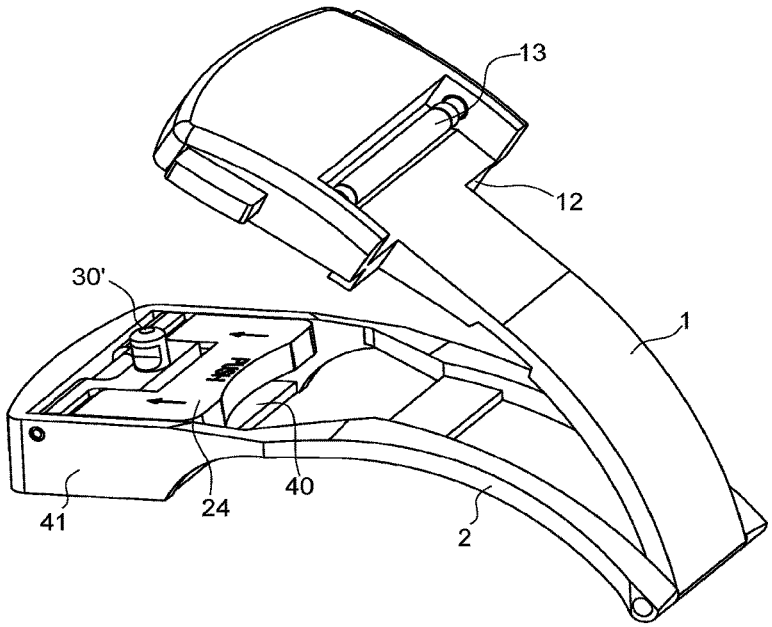
FIGS. 5, 6*a* and 6*b* are perspective views of a clasp according to a third embodiment of the invention.

As can be observed in FIG. 5, the second strip includes at its second end a bridge 40 for the passage of first strand 100. Bridge 40 may be pierced, depending on the material used to manufacture the strips of the clasp, in order to reduce manufacturing costs.

The first locking means may be formed, for example, by at least one spring catch 32 configured to hold and/or release a stud, called the upper stud 30', on second strip 2, so as to hold first strip 1 in its closed position against second strip 2 or to release first strip 1 into its released position.

According to a particularly advantageous aspect, first strip 1 includes a guide element 12 which can guide first strip 1 laterally with respect to second strip 2 when first strip 1 is folded onto second strip 2. Another advantage of this guide element 12 is that it prevents first strip 1 from being moved sideways and thus prevents wear, or even breakage of upper stud 30' when the clasp is closed.

Figure 6A:
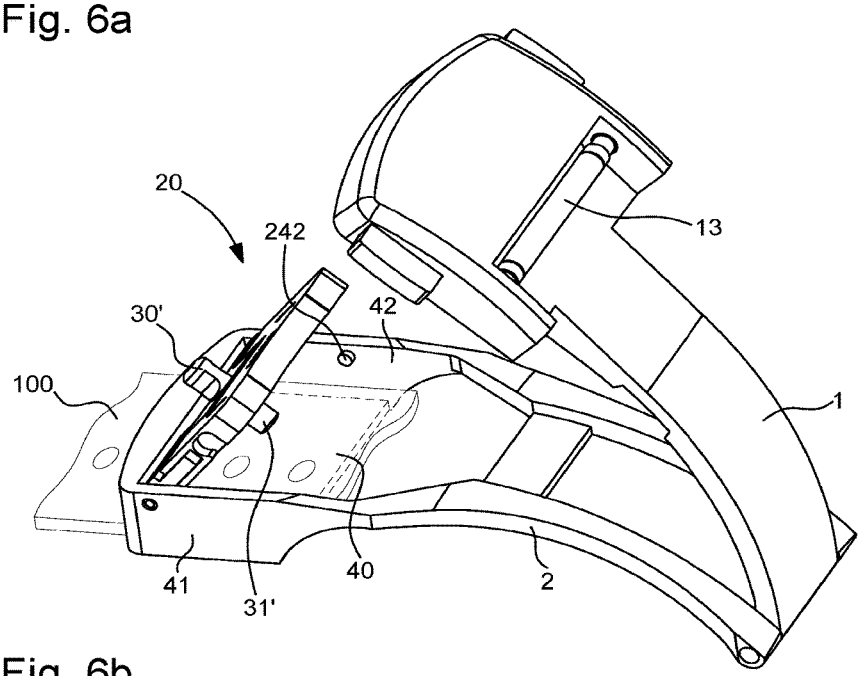
Figure 6B:
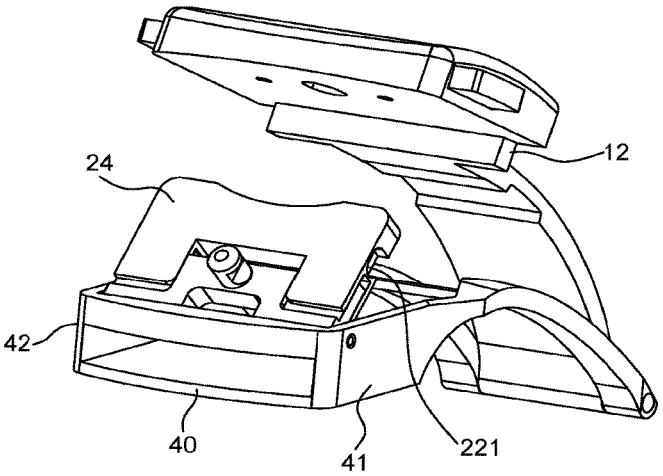

As can be observed in FIGS. 5, 6*a* and 6*b*, securing member 20 includes means for adjustment of the useful length of the bracelet; these adjustment means include a base plate 21 pivotally hinged at the second end of second strip 2 and the base plate is held by a bar 10.

Such an arrangement of base plate 21 and of second strip 2 allows first strand 100 to pass underneath base plate 21 through bridge 40 of second strip 2. Advantageously, first strand 100 passes through the adjustment means, where base plate 21 is hinged. As can be observed in the Figures, first strand 100 is held in its position via holding means such as a stud, called lower stud 31', intended to be inserted into a suitable hole in first strand 100 to define an anchoring point of the latter to the clasp. Of course, other holding means could have been envisaged by those skilled in the art within the scope of the present invention.

The adjustment means also include second locking means for holding base plate 21 in a closed position on second strip 2.

Advantageously, the second locking means are formed by a push-piece 24 arranged to be moved in a longitudinal direction of first strand 100, in response to an action of the user, between a first rest position in which base plate 21 is locked in a closed position on second strip 2, and a second pushed-in position in which base plate 21 is released from second strip 2.

As in the preceding embodiments, the second locking means include return means, such as springs 230, configured to exert a force on push-piece 24 in order to hold push-piece 24 in a closed position.

Base plate 21 includes guide means for push-piece 24 and springs 230, the guide means respectively taking the form of a guide slot 210 on either side of base plate 21 for push-piece 24 and of a guide cylinder 211 for each spring 230, springs 230 thus being laterally held in guide cylinder 211.

Push-piece 24 is formed by a body, 240, of equivalent width to the width of base plate 21, and has an arm 241 arranged at each of end thereof, arms 241 being configured to slide inside guide slots 210 and to cooperate in abutment with springs 230. As can be observed in the Figures, each arm 241 of push-piece 24 includes an outwardly oriented L-shaped groove 221 for cooperating with one of the lateral walls 41, 42 of bridge 40 of second strip 2.

According to the invention, bridge 40 has a pin 242 on the inner face of each of its lateral walls 41,42, preferably disposed in proximity to one of its ends, each pin 242 being configured to cooperate with a respective L-shaped groove 221 of push-piece 24.

Obviously, those skilled in the art can switch the position of pins 242 and of L-shaped grooves 221. Thus, pins 242 may be located on push-piece 24 and L-shaped grooves 221 on lateral walls 41 and 42 of bridge 40.

As can be observed in FIG. 5, when base plate 21 is in a closed position, springs 230 stress push-piece 24 such that pins 241 of bridge 40 remain in placed at the bottom of L-shaped grooves 221 of base plate 21. To release base plate 21, the user presses push-piece 24 so that pins 241 are stopped in the "foot" of the L of each L-shaped groove 221. The user can then lift base plate 21 and release first strand 100 by lifting the latter so as to extract the stud from first strand 100.

The invention also concerns a wristwatch including a bracelet provided with a clasp as previously described.

The invention also concerns a module for securing a strand to a fastener, such as a belt fastener for example, the securing module being provided with means for adjusting the length of the strand, these adjustment means including:

a base plate 21 secured to the second end of first strip 1 and a cover 22 pivotally hinged to base plate 21, the strand passing between base plate 21 and cover 22, and the strand being held by means of holding means disposed on the upper face and on the lower face of base plate 211, and second means for locking cover 22? in a closed position on base plate 21, provided in base plate 21.

According to the invention, the second locking means include a push-piece 24 arranged to be moved in a longitudinal direction of the strand, in response to an action of the user, between a first rest position in which cover 22 is locked in a closed position on base plate 21, and a second pushed-in position in which cover 22 is released from base plate 21.

As a result of these different aspects of the invention, there is provided a clasp of simple design for adjusting the length of a bracelet strand or belt.

Of course, the present invention is not limited to the illustrated example and is capable of various variants and modifications that will appear to those skilled in the art.

| LIST OF PARTS |
|---|
| 1. First strip |
| 10. Bar, |
| 11. Attachment link, |
| 12. Guide element |
| 13. Arbor |
| 100. first strand |
| 101. Second strand |
| 2. Second strip |
| 20. Securing member, |
| 200. Receptacle |
| 21. Base plate, |
| 210. Guide slots, |
| 211. Guide cylinder, |

-continued

| LIST OF PARTS |
|---|
| 212. Screw, |
| 213. Hollow, |
| 22. Cover, |
| 220. Lateral walls, |
| 221. L-shaped grooves, |
| 230. Springs, |
| 24. Push-piece, |
| 240. Push-piece body, |
| 241. Push-piece arm, |
| 242. Pins |
| 243. Through holes, |
| 25. Central orifice, |
| 26, 27. Longitudinal recesses, |
| 3. Third strip, |
| 30, 30. Upper stud, |
| 31, 31. Lower stud, |
| 32. Spring catch. |
| 40. Bridge |
| 41, 42. Lateral edges of the bridge |

What is claimed is:

1. A clasp of a bracelet, the bracelet clasp comprising:

a deployment buckle, including at least first and second strips, the first strip being hinged to the second strip at a first end of the second strip, the first strip being movable between a closed position, called a wearing position, in which the first strip is folded onto the second strip, and an open position, in which the first strip is released from the second strip, the second strip carrying, at a second end of the second strip, a securing structure to secure a first bracelet strand, a second bracelet strand being at least indirectly connected to the first strip, the first strip including a first lock to hold the first strip in its closed position, the securing structure including an adjustor of a useful length of the bracelet, the adjustor including:

a base plate secured and pivotally hinged to the second end of the second strip, the first strand passing between the base plate and the second strip and being held by a holding structure, and a second lock to hold the base plate in a closed position on the second strip, wherein the second lock includes a push-piece that is movable in a longitudinal direction of the bracelet, in response to an action of a user, between a first rest position in which the base plate is locked in the closed position on the second strip, and a second pushed-in position in which the base plate is released from the second strip.

2. The a clasp according to claim 1, wherein the base plate includes an L-shaped groove on each of lateral edges thereof.

3. The clasp according to claim 1, wherein the second strip includes a bridge at the second end receiving the base plate, the bridge including a pin on each edge thereof, each pin being configured to cooperate with the corresponding L-shaped groove.

4. The clasp according to claim 1, wherein the second lock includes a return structure to cooperate with the push-piece so as to hold the push-piece in a closed position.

5. The clasp according to claim 4, wherein said return structure includes at least one spring.

6. The clasp according to claim 1, wherein the base plate includes a guide to guide the push-piece.

7. The clasp according to claim 4, wherein the return structure rests in a guide to guide the push-piece.

8. The clasp according to claim 1, wherein the base plate includes a stud on an upper face thereof, called an upper stud, that is insertable in a suitable hole in the first strand to define an anchoring point.

9. The clasp according to claim 1, wherein the first strand is inserted through the adjustor, where the base plate is hinged on the second strip.

* * * * *